US011663985B2

(12) United States Patent
Fang et al.

(10) Patent No.: US 11,663,985 B2
(45) Date of Patent: May 30, 2023

(54) BACKLIGHT MODULE AND DISPLAY DEVICE

(71) Applicant: TCL China Star Optoelectronics Technology Co., Ltd., Guangdong (CN)

(72) Inventors: Xiaoli Fang, Guangdong (CN); Yu Wu, Guangdong (CN); Yuhong Fu, Guangdong (CN); Guangxing Xiao, Guangdong (CN)

(73) Assignee: TCL China Star Optoelectronics Technology Co., Ltd., Shenzhen (CN)

( * ) Notice: Subject to any disclaimer, the term of this patent is extended or adjusted under 35 U.S.C. 154(b) by 235 days.

(21) Appl. No.: 17/263,969

(22) PCT Filed: Dec. 21, 2020

(86) PCT No.: PCT/CN2020/137974
§ 371 (c)(1),
(2) Date: Jan. 28, 2021

(87) PCT Pub. No.: WO2022/116303
PCT Pub. Date: Jun. 9, 2022

(65) Prior Publication Data

US 2022/0398985 A1 Dec. 15, 2022

(30) Foreign Application Priority Data

Dec. 3, 2020 (CN) ..... 202011404442.4

(51) Int. Cl.
*G09G 3/34* (2006.01)

(52) U.S. Cl.
CPC ..... *G09G 3/3406* (2013.01); *G09G 2370/14* (2013.01)

(58) Field of Classification Search
CPC ..... G09G 3/3406; G09G 3/34; G09G 3/342; G09G 3/3426; G09G 2370/14; G02F 1/133602; G02F 1/133603; G02F 1/133612; G02F 1/133613
USPC ..... 345/102
See application file for complete search history.

(56) References Cited

U.S. PATENT DOCUMENTS

| | | | | |
|---|---|---|---|---|
| 7,289,098 | B2 * | 10/2007 | Ahn | G09G 3/3406 349/61 |
| 11,244,636 | B2 * | 2/2022 | Shi | G09G 3/3426 |
| 2009/0135195 | A1 * | 5/2009 | Chen | G09G 3/3426 345/589 |

FOREIGN PATENT DOCUMENTS

| | | |
|---|---|---|
| CN | 101609658 | 12/2009 |
| CN | 106210593 | 12/2016 |
| CN | 109064980 | 12/2018 |
| CN | 209070957 | 7/2019 |
| CN | 209591492 | 11/2019 |
| CN | 111477182 | 7/2020 |
| CN | 111508441 | 8/2020 |

(Continued)

*Primary Examiner* — Koosha Sharifi-Tafreshi

(57) ABSTRACT

The present application provides a backlight module and a display device. The present application converts a display image into control information through a driver board, and can precisely control a mini-LED backlight. The driver board is provided with multiple interfaces for transmitting control signals based on different transmission protocols, so the compatibility of the entire display device is improved. In addition, the driver board can be continuously updated by using programmable devices to meet the needs of users.

9 Claims, 2 Drawing Sheets

(56) References Cited

FOREIGN PATENT DOCUMENTS

| | | |
|---|---|---|
| CN | 111710312 | 9/2020 |
| CN | 111785224 | 10/2020 |
| CN | 111818284 | 10/2020 |

* cited by examiner

BACKLIGHT MODULE AND DISPLAY DEVICE

RELATED APPLICATIONS

This application is a National Phase of PCT Patent Application No. PCT/CN2020/137974 having International filing date of Dec. 21, 2020, which claims the benefit of priority of Chinese Patent Application No. 202011404442.4 filed on Dec. 3, 2020. The contents of the above applications are all incorporated by reference as if fully set forth herein in their entirety.

FIELD AND BACKGROUND OF THE INVENTION

The present application relates to a field of display panel technology and in particular, to a backlight module and a display device.

DESCRIPTION OF RELATED ART

At present, due to high contrast ratios and good image quality, mini-LED backlight technology has quickly drawn the attention of manufacturers of display panels in developing high-end products. Mini-LED backlight technology is to evenly distribute multiple LEDs in a multi-partition dynamic backlight to realize a more precise optical layout and more precise backlight control.

However, there are currently no control signals for adjusting the brightness of each LED of the backlight according to a display image.

SUMMARY OF THE INVENTION

The present application provides a backlight module and a display device to solve a problem that there are currently no control signals for controlling the brightness of a backlight LED according to a display image.

The present application provides a backlight module, comprising:

a light set; and a driver board connected to the light set, wherein the driver board is configured to transmit control signals to the light set, wherein the driver board comprises a plurality of interfaces configured to transmit control signals based on different transmission protocols and also comprises a driver chip, the driver chip is configured to obtain the control signals for controlling the light set according to a display image, and the display image is obtained through an external system board.

Furthermore, the backlight module comprises a plurality of low-voltage differential signaling (LVDS) interfaces arranged on the driver board, wherein the plurality of LVDS interfaces are configured to transmit low-voltage differential signals.

Furthermore, the transmission protocols comprise a serial peripheral interface (SPI) protocol and a V-by-one (VBO) protocol.

Moreover, the interfaces comprise two input interfaces and two output interfaces based on the VBO protocol, and the two input interfaces and the two output interfaces are configured to transmit the control signals based on the VBO protocol.

Moreover, the interfaces comprise two input interfaces and two output interfaces based on the SPI protocol, and the two input interfaces and the two output interfaces are configured to transmit the control signals based on the SPI protocol.

Moreover, the backlight module further comprises a plurality of power supply interfaces for supplying a working voltage to the driver board.

The present application further provides a display device, comprising the above-mentioned backlight module.

Furthermore, the display device further comprises a display panel arranged corresponding to the light set.

Furthermore, the control signal is configured to control the light set, and a corresponding light in the light set is lit up according to the display image.

Furthermore, the display device further comprises a system board for sending the display image to the driver board; and a control board configured to receive the display image sent from the driver board and generate the control signal according to the display image.

The embodiments of the present application provide a backlight module and a display device. A display image is converted into control information through a driver board to achieve precise control of a mini-LED backlight. The driver board is provided with multiple interfaces for transmitting control signals based on different transmission protocols, thus improving the compatibility of the entire display device. In addition, the driver board can be continuously updated by using programmable devices to meet the needs of users.

BRIEF DESCRIPTION OF THE SEVERAL VIEWS OF THE DRAWINGS

In order to more clearly illustrate the embodiments of the present disclosure or related art, figures which will be described in the embodiments are briefly introduced hereinafter. It is obvious that the drawings are merely for the purposes of illustrating some embodiments of the present disclosure, and a person having ordinary skill in this field can obtain other figures according to these figures without inventive work.

DESCRIPTION OF SPECIFIC EMBODIMENTS OF THE INVENTION

The technical solutions of the present application are clearly and completely described below in conjunction with the accompanying drawings with reference to the embodiments of the present application. Obviously, the described embodiments are only some of the embodiments of the present application, rather than all the embodiments. Based on the embodiments in the present application, all other embodiments obtained by those skilled in the art without inventiveness should be deemed to fall within the protection scope of the present application.

Figure 1:
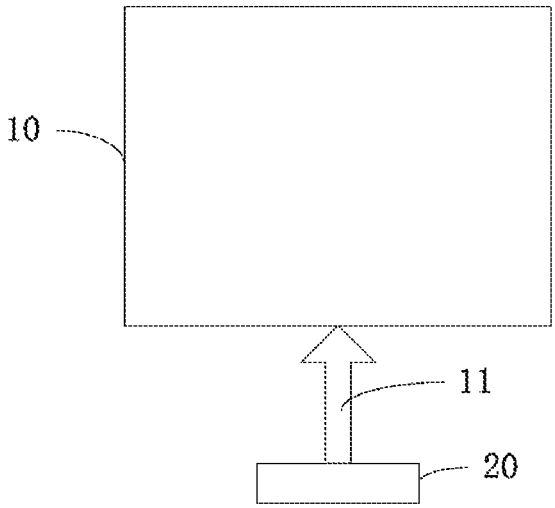
FIG. 1 is a schematic view illustrating a backlight module according to one embodiment of the present application.

As shown in FIG. 1, it is a schematic view illustrating a backlight module of the present application. The backlight module comprises a light set 10 and a driver board 20.

The driver board 20 is connected to the light set 10, wherein the driver board 20 is configured to transmit control signals 11 to the light set 10.

Figure 2:
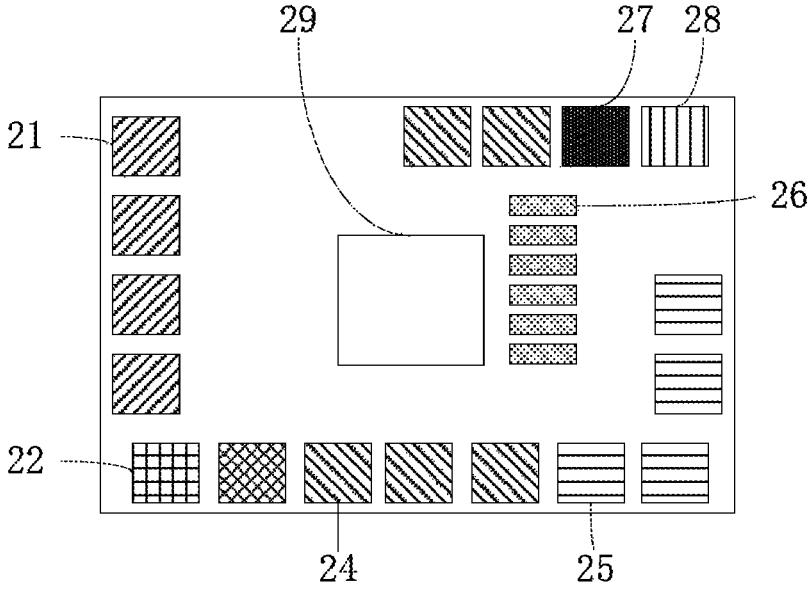
FIG. 2 is a schematic view illustrating a driver board according to one embodiment of the present application.

Referring to FIG. 2, the driver board 20 comprises a plurality of interfaces for transmitting control signals 11 based on different transmission protocols and comprises a driver chip 29.

The driver chip 29 is configured to obtain the control signals for controlling the light set 10 according to a display image, and the display image is obtained through an external system board 30.

The transmission protocols comprise a serial peripheral interface (SPI) protocol and a V-by-one (VBO) protocol.

It should be noted that the SPI protocol has four different modes. The backlight module is configured to supporting one of these modes by factory default settings. Both communication parties must work in this same mode. Accordingly, the SPI mode of the backlight module can be configured, and a communication mode of the backlight module can be controlled through clock polarity (CPO) and clock phase (CPHA).

The VBO protocol is a digital interface protocol standard for image information transmission. There is a strict handshake process between a sending end and a receiving end of the backlight module adopting the VBO transmission protocol during startup, and strict timing control is required.

In the present embodiment, the SPI interface 25 comprises two input interfaces and two output interfaces based on the SPI protocol, and the two input interfaces and the two output interfaces are used to transmit the control signals 11 based on the SPI protocol. The VBO interface 24 comprises two input interfaces and two output interfaces based on the VBO protocol, and the two input interfaces and the two output interfaces are used to transmit the control signals 11 based on the VBO protocol. Since the driver board 20 is provided with multiple interfaces for transmitting the control signals 11 based on different transmission protocols, the compatibility of the entire display device can be improved.

The driver board 20 also comprises: a plurality of low-voltage differential signaling (LVDS) interfaces 21, a power interface 22, a backup interface 28, and a flash interface 27. The backup interface 28 is a 12-pin interface.

The plurality of low-voltage differential signaling (LVDS) interfaces 21 are used to transmit low-voltage differential signals. In the present embodiment, the driver board 20 is provided with four LVDS interfaces. LVDS is a differential signaling technology with low power consumption, low bit error rates, low crosstalk, and low radiation. LVDS allows a data transmission rate more than 155 Mbps. LVDS uses a very low voltage swing to transmit high-speed differential data, which can achieve point-to-point connection or single point to multi-point connection.

The driver board 20 also comprises a plurality of power supply interfaces 26. The power supply interface 26 is configured to provide a working voltage to the driver chip 29.

The driver board 20 can achieve the following four modes.

Mode 1: Receive a VBO signal and an overall dimming signal, obtain the VBO signal and grayscale data (control signal) of different backlight partitions (zones) through algorithm, and output the grayscale data of different backlight partitions through the LVDS interface.

Mode 2: Receive a VBO signal, a display image, and an overall dimming signal, and output them.

Mode 3: Receive a DisplayPort (DP) signal of a computer, obtain a VBO signal and a control signal through algorithm, and output them.

Mode 4: For use in product display, receive a display image and a VBO signal, and output a control signal in an SPI format.

The embodiments of the present application provide a backlight module and a display device. The display image is converted into control information through a driver board to achieve precise control of a mini-LED backlight, and the driver board is provided with multiple interfaces for transmitting control signals based on different transmission protocols, thereby improving the compatibility of the entire display device. In addition, the driver board can be continuously updated by using programmable devices to meet the needs of users.

Figure 3:
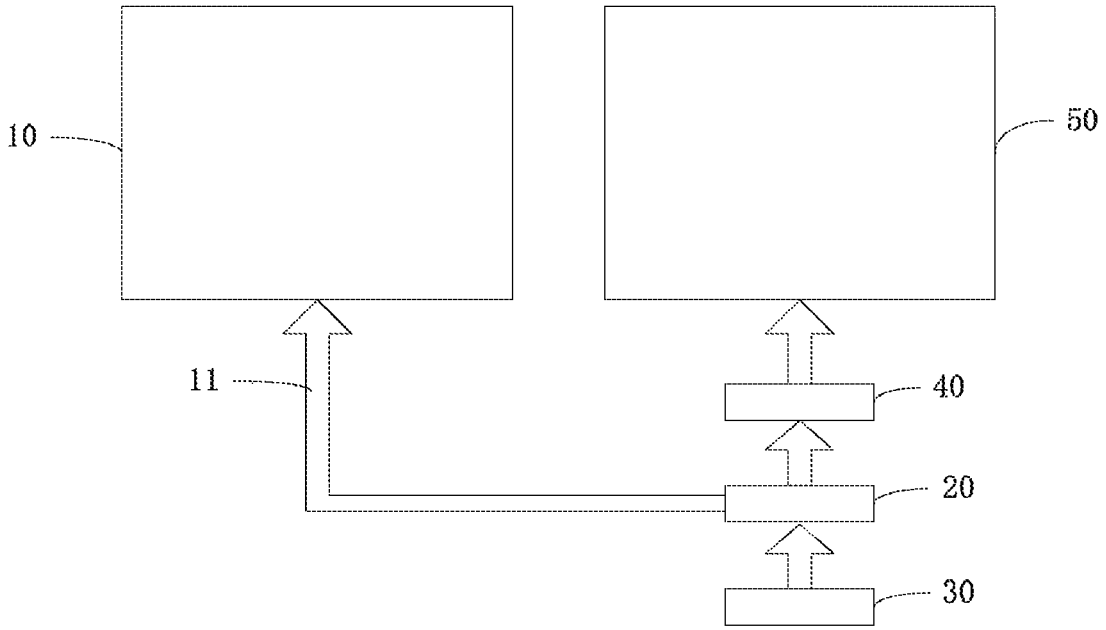
FIG. 3 is a schematic view illustrating a display device according to one embodiment of the present application.

As shown in FIG. 3, it is a schematic view of a display device according to one embodiment of the present application. The display device comprises: the backlight module described in the above embodiment, a system board 30, a control board 40, and a display panel 50.

The display panel 50 is arranged corresponding to the light set 10. The control signal is used to control the light set 10 and light up a corresponding light in the light set 10 according to the display image.

The system board 30 is configured to send the display image to the driver board 20. The control board 40 is configured to receive the display image sent from the driver board 20 and generate the control signal according to the display image.

The display device can be any product or component with a display function, such as a mobile phone, a tablet computer, a television, a monitor, a notebook computer, a digital photo frame, and a navigator. When the display device of the present embodiment adopts the backlight module described in the above embodiment, the display device has better display performance.

The embodiments of the present application provide a backlight module and a display device. A display image is converted into control information through a driver board to precisely control a mini-LED backlight, and the driver board is provided with multiple interfaces configured to transmit control signals based on different transmission protocols, thus improving the compatibility of the entire display device. In addition, the driver board can be continuously updated by using programmable devices to meet the needs of users.

In the above-mentioned embodiments, the description of each embodiment has its own emphasis. For those that are not described in detail in one embodiment, reference may be made to related descriptions of other embodiments.

Specific examples are used in the present disclosure to illustrate the working principles and embodiments of the present application. The description of the above embodiments is only used for ease of understanding the methods and main ideas of the present application. At the same time, those skilled in the art can make changes to the embodiments and the application in use according to the concepts of the present application. In summary, this specification should not be construed as a limitation to the present application.

What is claimed is:

1. A backlight module, comprising:

a light set; and a driver board connected to the light set, wherein the driver board is configured to transmit control signals to the light set, wherein the driver board comprises a plurality of interfaces configured to transmit control signals based on different transmission protocols and also comprises a driver chip, the driver chip is configured to obtain the control signals for controlling the light set according to a display image, and the display image is obtained through an external system board;

wherein the transmission protocols comprise a serial peripheral interface (SPI) protocol and a V-by-one (VBO) protocol.

2. The backlight module according to claim 1, comprising:

a plurality of low-voltage differential signaling (NDS) interfaces arranged on the driver board, wherein the plurality of LVDS interfaces are configured to transmit low-voltage differential signals.

3. The backlight module according to claim 1, wherein the interfaces comprise two input interfaces and two output interfaces based on the VBO protocol, and the two input interfaces and the two output interfaces are configured to transmit the control signals based on the VBO protocol.

4. The backlight module according to claim 1, wherein the interfaces comprise two input interfaces and two output interfaces based on the SPI protocol, and the two input interfaces and the two output interfaces are configured to transmit the control signals based on the SPI protocol.

5. The backlight module according to claim 1, comprising: a plurality of power supply interfaces for supplying a working voltage to the driver board.

6. A display device, comprising the backlight module of claim 1.

7. The display device according to claim 6, further comprising a display panel arranged corresponding to the light set.

8. The display device according to claim 6, wherein the control signal is configured to control the light set, and a corresponding light in the light set is lit up according to the display image.

9. The display device according to claim 6, wherein the display device further comprises a system board for sending the display image to the driver board; and a control board configured to receive the display image sent from the driver board and generate the control signal according to the display image.

* * * * *